US005664386A

United States Patent [19]

Palmersten

[11] Patent Number: 5,664,386

[45] Date of Patent: Sep. 9, 1997

[54] POINT-TO-POINT INTERLOCKING PANELS

[76] Inventor: Michael J. Palmersten, P.O. Box 25251, Woodbury, Minn. 55125

[21] Appl. No.: 712,157

[22] Filed: Sep. 12, 1996

Related U.S. Application Data

[63] Continuation of Ser. No. 333,193, Nov. 2, 1994, abandoned.

[51] Int. Cl.[6] ..... E04C 3/30

[52] U.S. Cl. ..... 52/588.1; 52/586.1

[58] Field of Search ..... 52/309.9, 309.4, 52/588.1, 589.1, 592.1, 592.2, 309.7

[56] References Cited

U.S. PATENT DOCUMENTS

| | | | |
|---|---|---|---|
| 3,353,315 | 11/1967 | Barker | 52/309.11 X |
| 3,557,503 | 1/1971 | Snyder | 52/309.11 |
| 4,743,485 | 5/1988 | Ting | 52/309.11 X |
| 4,769,963 | 9/1988 | Meyerson | 52/309.9 |
| 4,961,298 | 10/1990 | Nogradi | 52/309.7 X |
| 4,998,396 | 3/1991 | Palmeister | 52/595 |
| 5,086,599 | 2/1992 | Meyerson | 52/309.9 |
| 5,138,812 | 8/1992 | Palmeisten | 52/309.9 X |
| 5,216,861 | 6/1993 | Meyerson | 52/309.9 |
| 5,343,665 | 9/1994 | Palmeisten | 52/588.1 |
| 5,349,796 | 9/1994 | Meyerson | 52/309.11 |
| 5,448,865 | 9/1995 | Palmersten | 52/309.9 |
| B1 4,769,963 | 9/1991 | Meyerson | 52/309.9 |

*Primary Examiner*—Carl D. Friedman
*Assistant Examiner*—Beth Aubrey
*Attorney, Agent, or Firm*—Nawrocki, Rooney & Sivertson

[57] ABSTRACT

Modular panels having a foam a core and top and bottom surfaces covered by a metallic skin are interlocked with one another by forming the metal skins so that contiguous panels meet along a tight, substantially immovable seam. Abutting metal parts are bent at an angle slightly greater than ninety degrees so that they meet along a distinct line of contact, forming an ideal seam. The area of contact is small so that contiguous panels are easily slideable with respect to one another in a lateral direction during panel assembly. Another metal part may be bent at differing angles at the time of panel manufacture to vary the amount of force required to interlock contiguous panels. The mating panels form a space protected from the sun within which caulking compound is positioned, and an elongate stiffener enables the panels to be manufactured in elongated sizes.

8 Claims, 5 Drawing Sheets

POINT-TO-POINT INTERLOCKING PANELS

This application is a continuation of U.S. application Ser. No. 08/333,193, filed Nov. 2, 1994 now abandoned.

BACKGROUND OF THE INVENTION

1. Field of the Invention

This invention relates, generally, to interlocking modular panels of the type having a foam core with top and bottom surfaces covered by a metallic skin. More particularly, it relates to an interlocking panel design that forms a tight seam when the respective metal edges of contiguous panels are interlocked with one another.

2. Description of the Prior Art

Interlocking panels meet along a seam that is visible to the occupants of the structure. If the seam is wide, it gives the appearance of shoddy construction. Similarly, a narrow, tighter seam provides the appearance of solid, quality construction. Accordingly, numerous designs have been developed that attempt to reduce the size of the seam where abutting panels meet.

The designs that have been developed heretofore, however, are unsatisfactory for a number of reasons. A tight, immovable seam has eluded the art. Moreover, attempts to seal the seams with caulking compound to prevent moisture leakage have also proven unsuccessful because sunlight breaks down caulking compound over time.

The panels heretofore known are also of relatively small size because the foam is relatively brittle and breaks easily if the panels are large.

Earlier panel designs are also somewhat difficult to install because adjoining panels are not easily displaceable in a lateral direction because of the friction created by the mating of the metal edges of said adjoining panels.

Earlier panel designs also have the limitation that the force required to install them is fixed and unadjustable. It would be advantageous if there were a panel design where the force required to interlock adjacent panels could be adjustable. If such a design were available, a customer could order the same panel design with varying degrees of interlocking resistance as desired.

However, when the prior art is considered as a whole at the time the present invention was made, it was not obvious to those of ordinary skill in this art how the limitations of the prior art could be overcome and how the desired features could be provided.

SUMMARY OF THE INVENTION

The novel structure, when installed, avoids seam movement and thus solves a major problem that plagued earlier designs. Significantly, it provides a tight, narrow seam where opposing interlocking means meet one another at a distinct, sharply defined point along their respective lengths. It further provides a caulking pocket that seals the seam against leaks and which is protected from the deleterious effects of sunlight. It provides a double gutter means to further inhibit leakage, it allows easy lateral sliding between abutting panels to facilitate installation, and it may be strengthened with one or more strengthening members. Moreover, the force required to bring contiguous interlocking means into engagement with one another can be varied expediently.

The novel panel includes a foam core having a top and a bottom surface, a first metallic skin for covering said top surface and a second metallic skin for covering said bottom surface, said first metallic skin having a first end and a second end, said first metallic skin first end having a first part that is unbent and which overlies said top surface, said first metallic skin first end having an unbent second part coplanar with said first part, said unbent second part extending in cantilevered relation to a first edge of said panel, said first metallic skin first end having a third part integral with said second part, said third part bent toward a center of said core slightly more than ninety degrees, thereby forming an included angle with said second part that is slightly less than ninety degrees, said first metallic skin first end having a fourth part integral with said third part, said fourth part being bent toward the center of said core and toward said first core edge at a predetermined angle, said first metallic skin first end having a fifth part integral with said fourth part and bent toward said top surface of said core and said first core edge at a predetermined angle of about ninety degrees, said second metallic skin first end having five parts that correspond to said five parts of said first metallic skin first end in mirror image relation thereto, said first metallic skin second end having five parts that cooperate with the five parts of said first metallic skin first end to facilitate interlocking of contiguous panels when laid in edge to edge relation to one another, said first metallic skin second end having a first unbent part that overlies said foam core, said first metallic skin second end having a second bent part integral with said first part that is bent slightly more than ninety degrees relative to said first part toward said center of said core, an included angle between said first and second parts being slightly less than ninety degrees, said first metallic skin first end and said first metallic skin second end abutting one another along a first point-like line of contact when contiguous panels are disposed in interlocking relation to one another, said point-like line of contact being where said first metallic skin first end second part abuts said first metallic skin second end second part, said first metallic skin second end having a third part integral with said second part bent at an obtuse angle with respect to said second part so that it extends toward said center of said core and away from said second core edge, said first metallic skin second end having a fourth part integral with said third part, said fourth part being bent at an obtuse angle with respect to said third part and being disposed generally parallel to said top and bottom surfaces of said core in a direction away from said second core edge, said first metallic skin second end having a fifth part integral with said fourth part, said fifth part being bent about ninety degrees in a direction toward said top surface of said core, said fifth part having a predetermined extent, whereby said fourth part of said first metallic skin first end slides over said fifth part of said first metallic skin second end when contiguous panel edges are brought into interlocking relation to one another, and whereby the predetermined angular orientation of said fourth part of said first metallic skin first end and the predetermined height of said fifth part of said first metallic skin second end determine the amount of force required to place contiguous panels into interlocking relation to one another, said second end of said second metallic skin having five parts disposed in mirror image relation to the five parts of said first metallic skin second end.

An important object of the present invention is to provide a panel design that avoids seam movement and which therefore solves a major problem of prior art panels in the field of this invention.

Another object is to provide a panel having a caulking pocket for sealing the seam against leaks.

An object closely related to the foregoing is to provide a design that protects the caulking compound from the sun.

Still another object is to provide a panel having a double gutter means to further inhibit leakage.

Another very important object is to provide a panel having a construction that allows easy lateral sliding between abutting panels to facilitate installation.

Another object is to provide a means for strengthening a panel of the foam core, metallic skin type.

Yet another object is to provide a panel design where the force required to interlock mating panels is easily adjustable at the time of panel manufacture.

Another mayor object is to provide an interlocking panel design that has very narrow, sharply defined seams where abutting panels meet.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
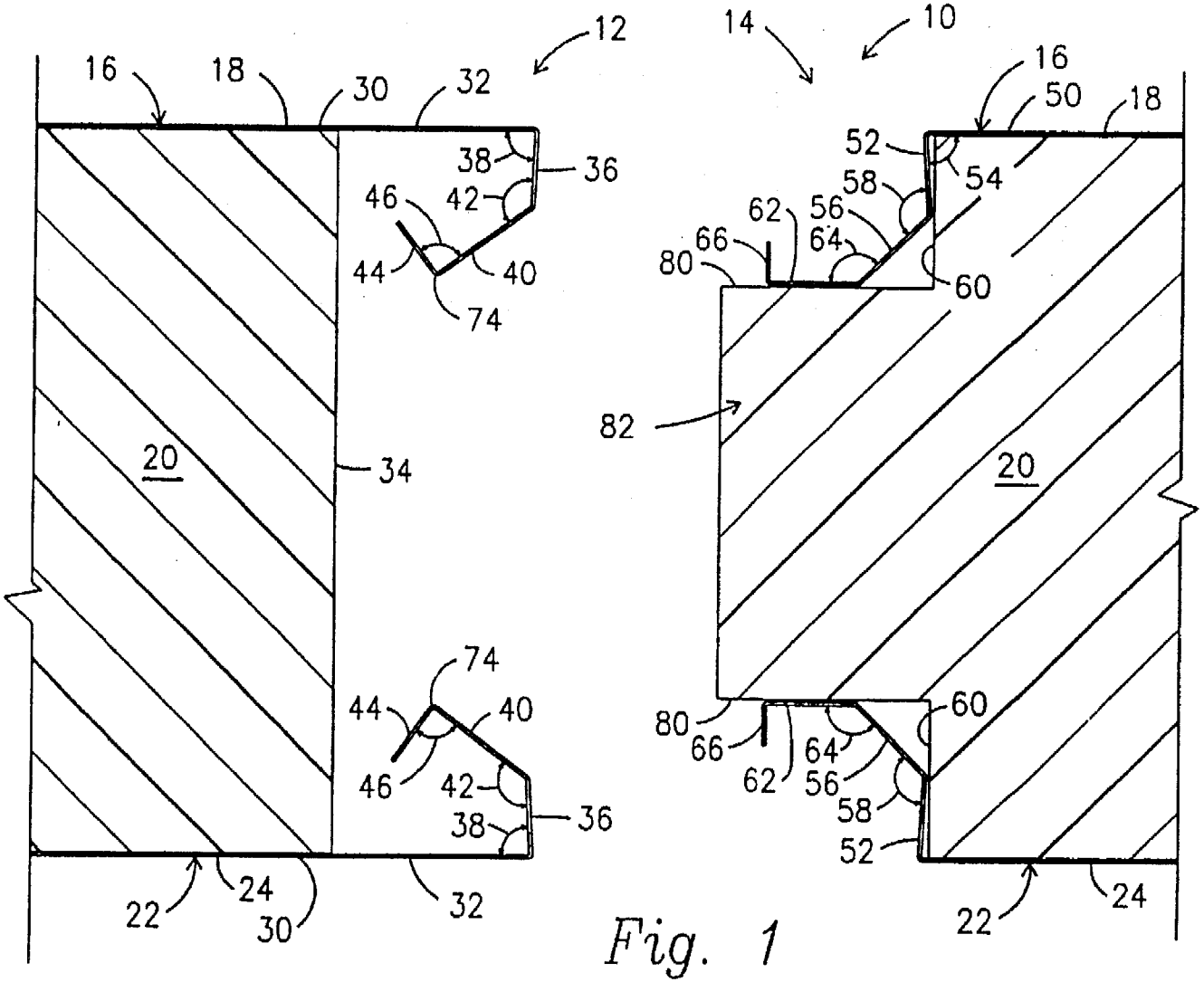
FIG. 1 is a side elevational view of a first embodiment of the invention when mating edges of contiguous panels are spaced apart from one another prior to assembly.

Referring now to FIG. 1, it will there be seen that an illustrative embodiment of the invention is denoted as a whole by the reference numeral 10.

First panel edge 12 and second panel edge 14 are depicted in spaced relation to one another, prior to interlocking; it should be understood that each panel has a first edge 12 and a second edge 14 at its opposite ends.

In all embodiments, a metal skin 16 overlies top surface 18 of foam core 20 and a metal skin 22 overlies bottom surface 24 of said foam core 20.

Metal skins 16 and 22 are bent the same way in all embodiments as well; only the shape of the foam core varies from one embodiment to the next.

Skin 16 of interlocking means 12 has five distinct parts. First part 30 overlies and is secured by a suitable adhesive to top surface 18 of foam core 20. Second part 32 is coplanar with first part 30 and extends in cantilevered relation to first core edge 34. Third part 36 is bent toward the center of the core, i.e., away from top surface 18; included angle 38 is slightly less than ninety degrees. Fourth part 40 is bent toward core edge 34 and toward the center of the core at an angle that may be varied within a rather broad range of angles. As shown in FIG. 1, angle 42 is about one hundred twenty degrees, but due to the flexibility of the metal skin, said angle can be varied easily for purposes described hereinafter. Fifth part 44 is bent toward core edge 34 and away from the core center; angle 46 between the fourth and fifth parts is about ninety degrees as depicted.

Bottom skin 22 of interlocking means 12 has the same construction and forms a mirror image of the above-disclosed construction; accordingly, the same reference numerals are applied to the corresponding parts.

Skin 16 of interlocking means 14 also has five parts. Unbent first part 50 is secured to core 20 and overlies it as shown. Second part 52 is bent toward the center of the core at an included angle 54 that is slightly less than ninety degrees. Third bent part 56 is bent toward the center and away from edge 60 of the core at an angle 58 of about one hundred thirty five degrees. Fourth bent part 62 extends away from core edge 60 in parallel relation to the top and bottom surfaces of core 20; angle 64 between the third and fourth parts is about one hundred thirty five degrees. Fifth bent part 66 extends towards the top surface of the core and is bent about ninety degrees relative to the fourth bent section 62. The height of fifth bent part 66 may be varied to change the amount of force required to interlock mating panel edges.

Bottom skin 22 of interlocking means 14 has a mirror image construction and its parts are therefore numbered the same as the parts of top skin 16.

Figure 2:
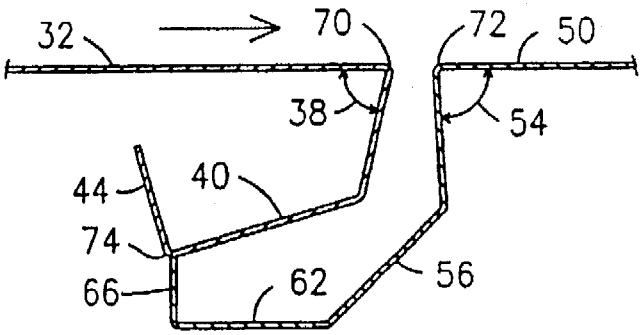
FIG. 2 is a side elevational view of said first embodiment showing the metal edges of contiguous panels during the assembly process when the deformable part of the first interlocking means is at its position of maximum deflection.
Figure 3:
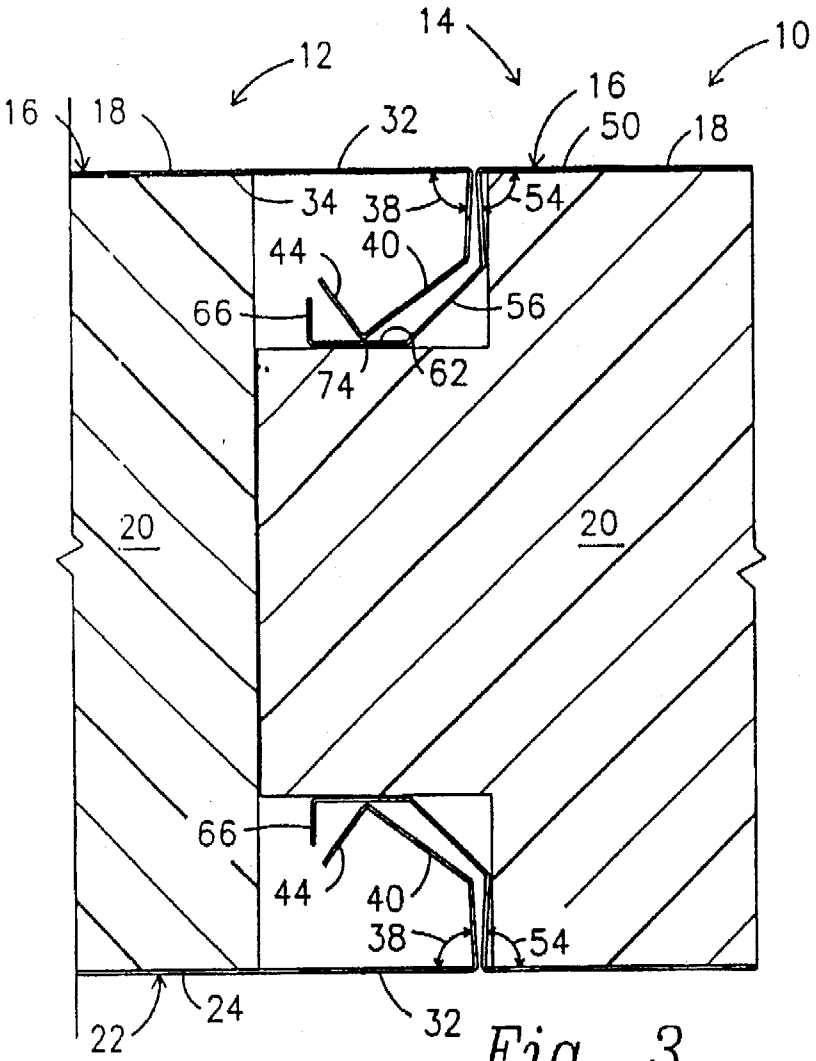
FIG. 3 is a side elevational view of said first embodiment when contiguous panel edges are fully interlocked with one another.

FIG. 2 illustrates how fourth part 40 of the first interlocking means is displaced from its position of repose as it is slid over fifth part 66 of the second interlocking means, and FIG. 3 depicts the respective positions of said first and second interlocking means when they are fully interlocked with one another.

Figure 4:
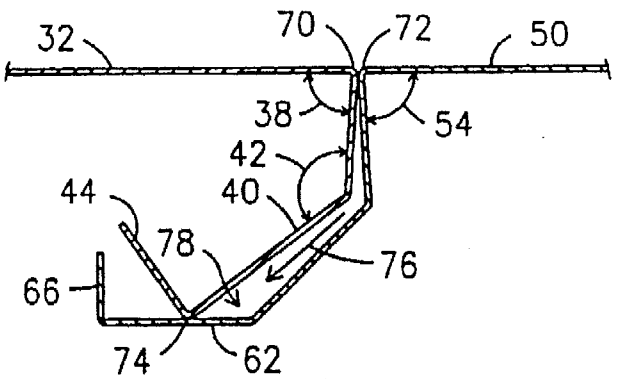
FIG. 4 is an enlarged view of the fully interlocked interlocking means.

FIG. 4 is an isolated view illustrating the effect of the sizing of angles 38 and 54; since each angle is slightly less than ninety degrees, the first and second interlocking means meet along points 70 and 72, thereby forming a much tighter seam than possible if said angles were ninety degree angles. Of course, points 70 and 72 are actually lines having the same extent as the transverse extent of panel 10, but a line is a series of points so it may be said that the contact between mating panel edges is point-to-point or line-to-line.

Another point-to-point contact between the interlocking means occurs along the line where point 74 of the first interlocking means contacts part 62 of the second interlocking means.

These point-to-point contacts eliminate most of the friction between the first and second interlocking means when abutting panels are displaced transversely with respect to one another as may be required during panel assembly. However, the novel arrangement of parts, while minimizing resistance to transverse movement, maximizes resistance to longitudinal movement. Note how the interlocked parts are unable to separate in a longitudinal direction. Thus it is said that the novel assembly minimizes seam movement.

Directional arrow 76 in FIG. 4 indicates the path water would have to take to penetrate the novel seam; note the double gutter effect provided by the respective bent parts of the novel assembly.

Space 78 for receiving caulking compound is also best depicted in FIG. 4. This further seals the seam against leaks.

Note that an increase in angle 42 of the first interlocking means will increase the amount of force required to position part 40 in its FIG. 2 position, and that decreasing said angle will decrease the amount of said force. Accordingly, the size of angle 42 is preselected when the novel interlocking means is manufactured, and customers may purchase the panels based upon the amount of resistance to interlocking they desire. The same effect is also achieved by increasing the vertical extent of part 66.

As shown in FIGS. 1–3, top surface 80 of protruding tongue 82 supports part 62 of the second interlocking means so that it is not displaced when part 40 of the first interlocking means is riding over part 66 of the second interlocking means as depicted in FIG. 2. As a result, all of the adjustment of the resistance to interlocking is provided by the adjustment of angle 42 or the height of part 66, or a combination of both, i.e., parts 62 and 66 of the second interlocking means are unyielding in view of the support provided by tongue 82.

Figure 5:
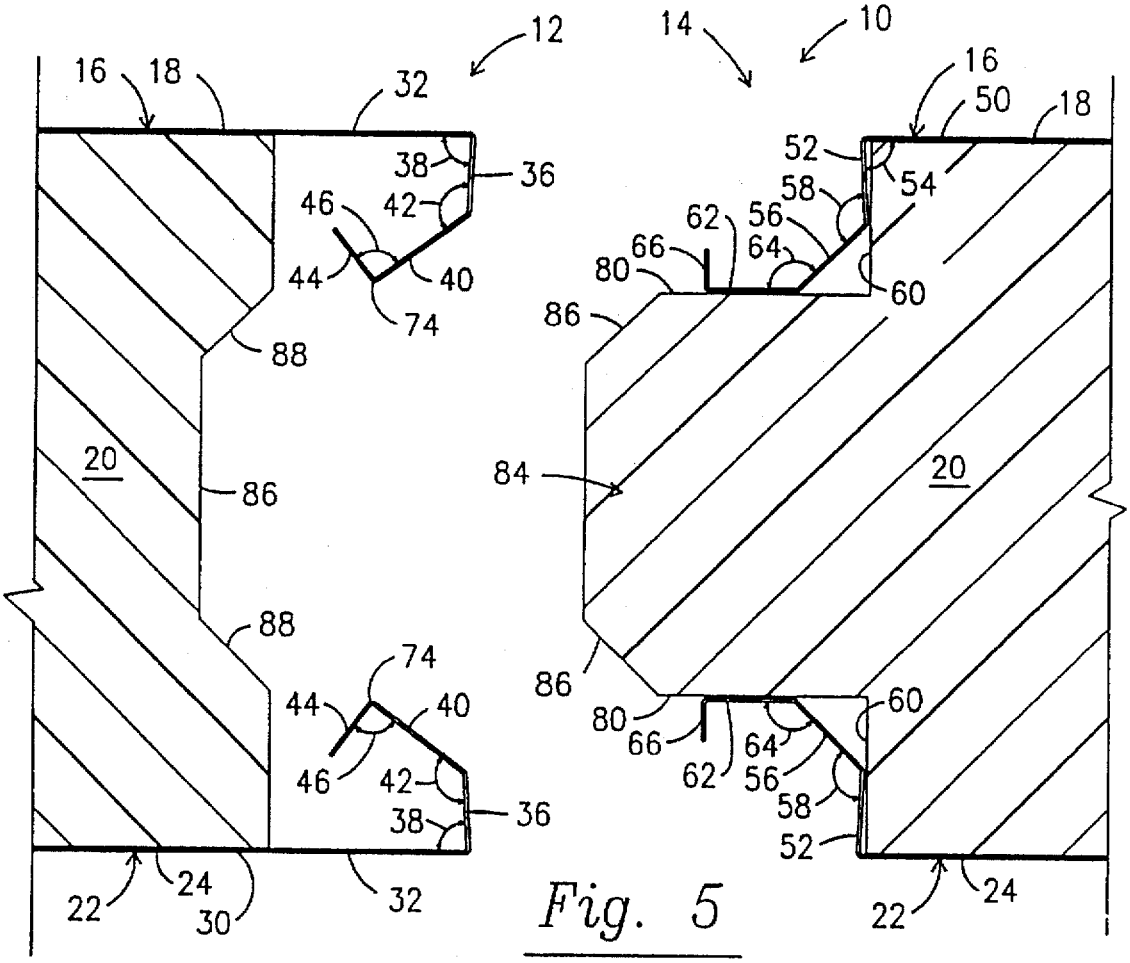
FIG. 5 is a side elevational view of a second embodiment of the invention.

In all of the remaining embodiments, the metallic part of the interlocking means are the same as described above, but the foam itself is also sculpted in ways different from the first embodiment to enhance the interlocking of contiguous panel edges. Thus, FIG. 5 depicts a tongue that interlocks with a groove 86; in the claims that follow, this arrangement is referred to as a flat-ended bevelled tongue and flat-bottomed bevelled groove. The longitudinal extent of the top and bottom surfaces of tongue 84, collectively denoted 80, are the same as in the first embodiment, but the protruding bevelled part 86 thereof extends there beyond. Said bevelled part 86 abuts recessed bevelled part 88 of the first edge of the foam core when the panels are assembled.

Figure 6:
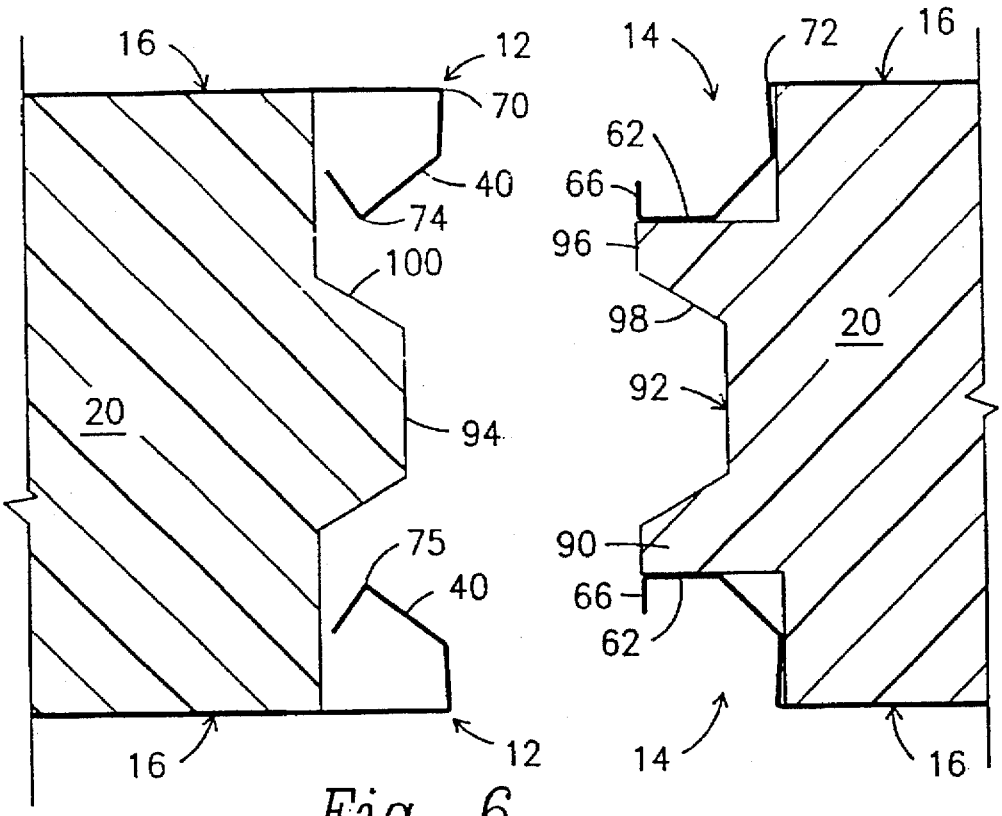
FIG. 6 is a side elevational view of a third embodiment thereof.

The arrangement of FIG. 6 is referred to as the grooved tongue arrangement in the claims that follow. Tongue 90 has less longitudinal extent than tongue 80 of the first embodiment and does not extent beyond part 62 of the second interlocking means; however, it still fully supports said part 62. Bevelled tongue 94 of the first core edge accommodates the ungrooved parts 96 of tongue 90 so that bevelled surface 98 of the grooved tongue 90 abuts bevelled surface 100 of tongue 94 when contiguous panels are connected to one another.

Figure 7:
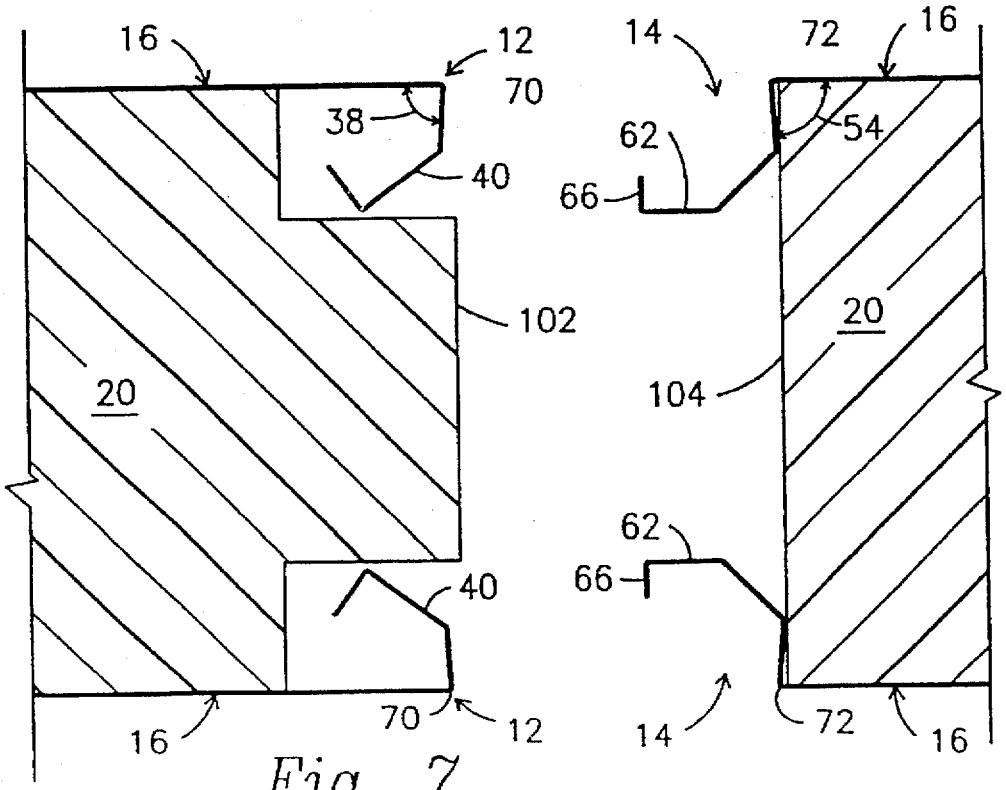
FIG. 7 is a side elevational view of a fourth embodiment thereof.

The foam cores of the FIG. 7 embodiment are reversed vis a vis the foam cores of the first embodiment. Thus tongue 102 is formed in the first panel edge and the second panel edge is unsculpted or flat. Significantly, part 62 of the second interconnecting means is not supported in this embodiment; accordingly, this embodiment presents the least resistance to assembly of all the depicted embodiments.

Figure 8:
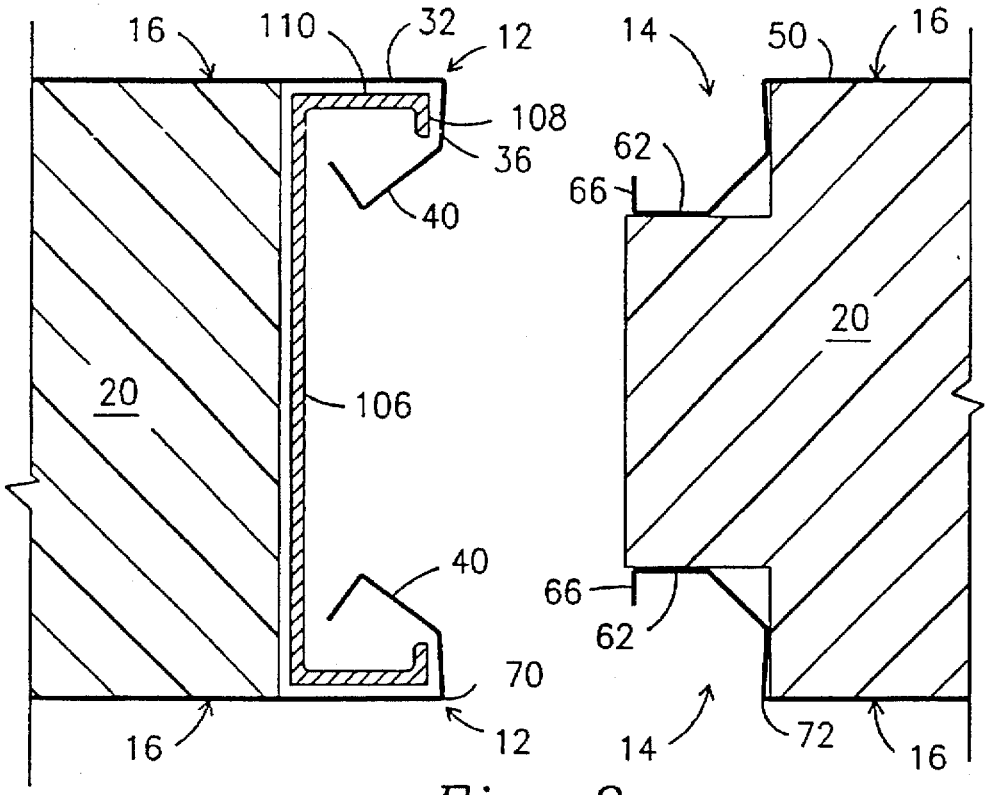
FIG. 8 is a side elevational view of a fifth embodiment thereof, depicting a first panel strengthening means.

The FIG. 8 embodiment differs from the FIG. 1 embodiment only by the addition of stiffener 106 thereto. Stiffener 106 is metallic and channel-shaped as shown, and may have a transverse extent the same as the transverse extent of the panel which it strengthens. Note how part 108 of the stiffener has a slightly less extent than part 36 of the first interconnecting means, and how part 110 is accommodated within part 32. Thus, stiffener 106 is easily slideably insertable within the first interconnecting means. This innovation enables the strengthening of foam cores of virtually any transverse extent.

Figure 9:
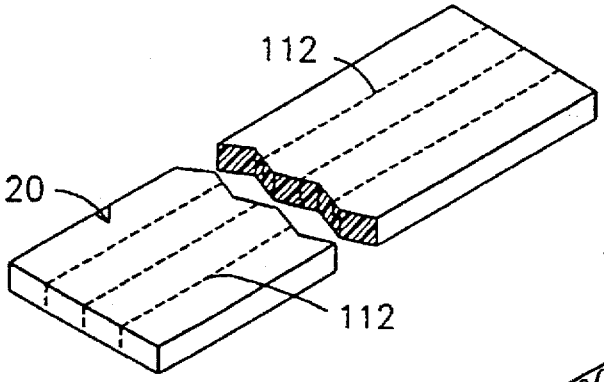
FIG. 9 is a broken, perspective view of a panel having saw cuts formed therein.
Figure 10:
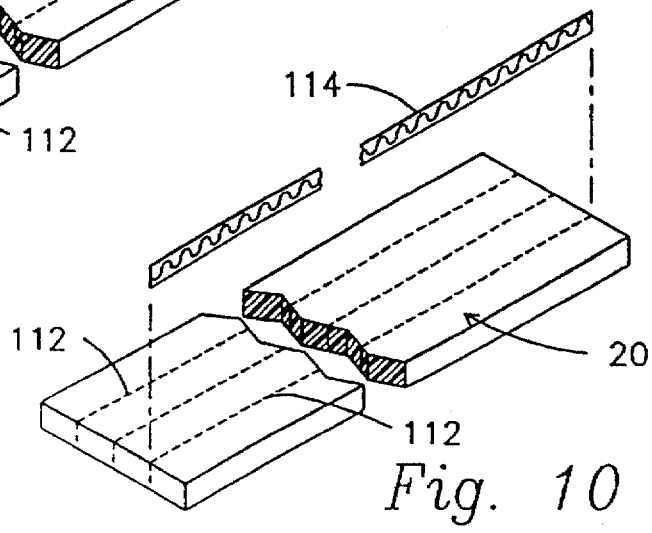
FIG. 10 is an exploded perspective view of a second panel strengthening means.

Another stiffening means is shown in FIG. 10. A plurality of parallel, longitudinally extending, very thin saw cuts, collectively denoted 112 in FIGS. 9 and 10, are formed in the foam core 20 of a panel before the metal skins are adhered thereto. As shown in the drawing, each cut extends about two-thirds or three-fourths of the way through the panel; empirical studies may show that a different depth is optimal, and such optimal depth is within the scope of this invention. An equal-numbered plurality of elongate metal stiffeners 114, only one of which is shown in FIG. 10, is inserted in the respective slots and adhered thereto by applying an adhesive on opposite sides thereof prior to insertion into said slots. This enables the panels to be made of extra long construction without breakage.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A panel, comprising:

a foam core having a top and a bottom surface and a first and a second core edge;

a first metallic skin for covering said top surface and a second metallic skin for covering said bottom surface;

said first metallic skin having a first end and a second end;

said first metallic skin first end having a first part that is unbent and which overlies a portion of said top surface;

said first metallic skin first end having an unbent second part coplanar with said first part, said unbent second part extending in cantilevered relation to said first edge of said panel;

said first metallic skin first end having a third part integral with said second part, said third part bent toward said first core edge slightly more than ninety degrees, thereby forming an included angle with said second part that is slightly less than ninety degrees;

said first metallic skin first end having a fourth part integral with said third part, said fourth part being bent toward said first core edge at a predetermined angle;

said first metallic skin first end having a fifth part integral with said fourth part and bent toward said top surface of said core and said first core edge at a predetermined angle of about ninety degrees relative to said fourth part;

said second metallic skin having a first end and a second end;

said second metallic skin first end having five parts that correspond to said five parts of said first metallic skin first end in mirror image relation thereto;

said first metallic skin second end having five parts that cooperate with the five parts of said first metallic skin first end to facilitate interlocking of contiguous panels when laid in edge to edge relation to one another;

said first metallic skin second end having a first unbent part that overlies a portion of said top surface of said foam core;

said first metallic skin second end having a second bent part integral with said first part that is bent slightly more than ninety degrees relative to said first part toward said center of said core, an included angle between said first and second parts being slightly less than ninety degrees;

said first metallic skin second end having a third part integral with said second part bent at an obtuse angle with respect to said second part so that it extends toward said center of said core and away from said second core edge;

said first metallic skin second end having a fourth part integral with said third part, said fourth part being bent at an obtuse angle with respect to said third part and being disposed generally parallel to said top and bottom surfaces of said core in a direction away from said second core edge;

said first metallic skin second end having a fifth part integral with said fourth part, said fifth part being bent about ninety degrees relative to said fourth part in a direction toward said top surface of said core;

said fifth part having a predetermined extent;

whereby said fourth part of said first metallic skin first end slides over said fifth part of said first metallic skin second end when contiguous panel edges are brought into interlocking relation to one another; and whereby the predetermined angular orientation of said fourth part of said first metallic skin first end and the predetermined height of said fifth part of said first metallic skin second end determine the amount of force required to place contiguous panels into interlocking relation to one another, such that said first metallic skin first end and said first metallic skin second end abut one another along a first point-like line of contact when contiguous panels are disposed in interlocking relation to one another, said point-like line of contact being where said first metallic skin first end second part abuts said first metallic skin second end second part.

2. The panel of claim 1, further comprising:

said second end of said second metallic skin having five parts disposed in mirror image relation to the five parts of said first metallic skin second end.

3. The panel of claim 3, further comprising:

said first core edge being flat;

said second core edge having a flat-ended tongue projecting therefrom, said flat-ended tongue abutting said flat first core edge when contiguous panels are disposed in interlocking relation to one another.

4. The panel of claim 2, further comprising:

said first core edge having a flat-bottomed bevelled groove;

said second core edge having a flat-ended bevelled tongue projecting therefrom, said tongue having bevelled sidewalls formed complementarily with bevelled sidewalls of said flat-bottomed bevelled groove, said flat-ended bevelled tongue fitting within said flat-bottomed bevelled groove when contiguous panels are disposed in interlocking relation to one another.

5. The panel of claim 2, further comprising:

said first core edge having a flat-ended tongue formed therein, said flat-ended tongue having bevelled sidewalls;

said second core edge having a grooved tongue formed therein, said groove having-beveled sidewalls that mate with the beveled sidewalls of said flat-ended tongue when contiguous panels are disposed in interlocking relation to one another.

6. The panel of claim 2, further comprising:

said first core edge having a flat-ended tongue projecting therefrom; and said second core edge being flat;

whereby said flat-ended tongue abuts said flat second core edge when contiguous panels are disposed in interlocking relation to one another.

7. The panel of claim 3, further comprising:

an elongate stiffener having the general shape of a squared "C";

said elongate stiffener having a flat back part that abuts said flat first core edge;

said elongate stiffener having a straight upper part and a straight lower part that respectively abut the second parts of said first and second metallic skins; and said elongate stiffener having a first straight outer part and a second straight outer part that respectively abut the third parts of said first and second metallic skins;

whereby said stiffener strengthens said foam core and enables the manufacturing of foam cores having a greater extent than foam cores lacking said stiffener.

8. The panel of claim 1, further comprising:

at least one saw cut formed in said panel;

said saw cut having a predetermined depth; and a stiffening means disposed within said saw cut to strengthen said panel.

* * * * *